US008823480B2

(12) United States Patent
Dalmia et al.

(10) Patent No.: US 8,823,480 B2
(45) Date of Patent: Sep. 2, 2014

(54) PLANAR ELECTRONIC DEVICE

(75) Inventors: Sidharth Dalmia, Fair Oaks, CA (US); Mark Patrick McGrath, West Sacramento, CA (US); Sun Zhuowen, Sacramento, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/572,393

(22) Filed: Aug. 10, 2012

(65) Prior Publication Data

US 2014/0043131 A1 Feb. 13, 2014

(51) Int. Cl.
*H01F 5/00* (2006.01)
*H01F 27/28* (2006.01)

(52) U.S. Cl.
USPC ..... 336/200; 336/182

(58) Field of Classification Search
USPC ..... 336/200, 145, 182, 90, 229, 220, 221
See application file for complete search history.

(56) References Cited

U.S. PATENT DOCUMENTS

| | | | | |
|---|---|---|---|---|
| 7,196,607 | B2 * | 3/2007 | Pleskach et al. | 336/200 |
| 7,477,128 | B2 | 1/2009 | Quilici | |
| 7,671,716 | B2 * | 3/2010 | Chen | 336/200 |
| 7,821,374 | B2 | 10/2010 | Harrison et al. | |
| 2005/0156698 | A1 * | 7/2005 | Pleskach et al. | 336/200 |
| 2006/0152322 | A1 * | 7/2006 | Whittaker et al. | 336/200 |
| 2010/0295646 | A1 * | 11/2010 | Harrison et al. | 336/192 |
| 2011/0242713 | A1 | 10/2011 | Dalmia et al. | |
| 2011/0272094 | A1 | 11/2011 | Dalmia et al. | |

* cited by examiner

*Primary Examiner* — Alexander Talpalatski
*Assistant Examiner* — Mangtin Lian

(57) ABSTRACT

A planar electronic device includes a planar substrate having a cavity configured to receive a ferrite material body therein. The planar substrate has an upper side and a lower side and conductive vias extending through the substrate. Top conductors are provided on the upper side of the planar substrate and are electrically connected to corresponding conductive vias. Bottom conductors are provided on the lower side of the planar substrate and are electrically connected to corresponding conductive vias. The bottom conductors, top conductors and conductive vias define a primary conductive loop and a secondary conductive loop. An upper cover layer covers the upper side and has a high permittivity. The upper cover layer is positioned relative to the top conductors to increase capacitance between the primary and secondary loops.

12 Claims, 6 Drawing Sheets

PLANAR ELECTRONIC DEVICE

BACKGROUND OF THE INVENTION

The subject matter herein relates generally to planar electronic devices, such as transformers, inductors, baluns, couplers, or fillers.

Some known electronic devices include planar bodies, such as circuit boards, that include one or more magnetic components built into the planar bodies. The magnetic component can include a ferrite core with conductive winding extending around the ferrite core. Some of these magnetic components include two conductive windings that are not conductively coupled with each other. For example, the conductive windings may not be physically or mechanically coupled such that electric current cannot flow through one conductive winding directly onto the other conductive winding. The current flowing through one winding generates a magnetic field in the core and in the other winding. The magnetic field in the other winding generates an electric current in the other winding. The electrical performance of the device can be determined by a variety of parameters, such as the ratio of the number of turns in the first winding to the number of turns in the second winding, the shape of the first and/or second windings, the impedance of the first and second windings, and the like.

The conductive windings typically include top conductors, bottom conductors, and conductive vias therebetween. Some planar electronic devices include circular ferrite cores, while other planar electronic devices include non-circular ferrite cores. The size and shape of the ferrite cores has an effect on density of the conductive windings as well as the layout of the conductive windings. Typically, the conductors making the windings are closely spaced to maximize capacitive coupling between adjacent windings. The layout of such conductors may have adjacent primary and secondary sections that are different (e.g. one short and one long), which negatively affects the performance of the planar electronic device. Additionally, some conductors suffer from degraded signals, such as from return loss. Furthermore, particularly at high frequency, planar electronic devices have poor performance compared to wired counterparts due to less primary and secondary capacitance.

A need exists for planar electronic devices having increased performance.

BRIEF DESCRIPTION OF THE INVENTION

In one embodiment, a planar electronic device is provided that includes a planar substrate having a cavity configured to receive a ferrite material body therein. The planar substrate has an upper side and a lower side and conductive vias extending through the substrate. Top conductors are provided on the upper side of the planar substrate and are electrically connected to corresponding conductive vias. Bottom conductors are provided on the lower side of the planar substrate and are electrically connected to corresponding conductive vias. The bottom conductors, top conductors and conductive vias define a primary conductive loop and a secondary conductive loop. An upper cover layer covers the upper side and has a high permittivity. The upper cover layer is positioned relative to the top conductors to increase capacitance between the primary and secondary loops.

In another embodiment, a planar electronic device is provided including a planar substrate having a cavity configured to receive a ferrite material body therein. The planar substrate has an upper side and a lower side and conductive vias extending through the substrate. Top conductors are provided on the upper side of the planar substrate and are electrically connected to corresponding conductive vias. Bottom conductors are provided on the lower side of the planar substrate and are electrically connected to corresponding conductive vias. The bottom conductors, top conductors and conductive vias define a primary conductive loop and a secondary conductive loop. An upper cover layer covers the upper side. The upper cover layer has a metal petal deposited thereon covering at least one top conductor of the primary conductive loop and at least one top conductor of the secondary conductive loop to increase capacitance between the primary and secondary conductive loops.

DETAILED DESCRIPTION OF THE INVENTION

Figure 1:
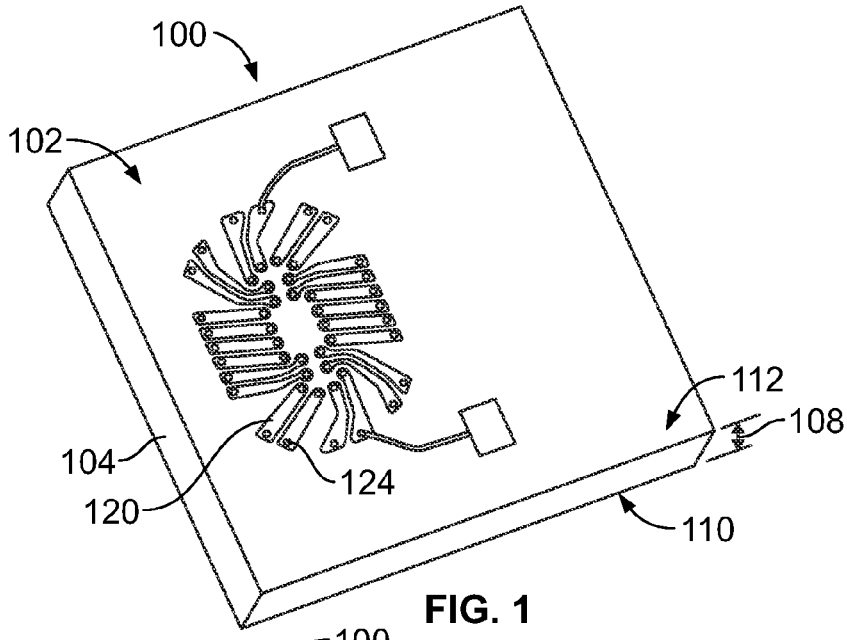
FIG. 1 is a perspective view of one embodiment of a planar electronic device.

FIG. 1 is a perspective view of one embodiment of a planar electronic device 100 having a magnetic component 102. The magnetic component 102 shown in FIG. 1 is a transformer device. Alternatively, the magnetic component 102 may be or include another electronic device or component, such as an inductor, filter, balun, coupler, and the like, that includes a ferrite body or other magnetic material. The magnetic component 102 is disposed in a planar dielectric or non-conductive substrate 104. The substrate 104 holds a ferrite material body 106 (shown in FIG. 2). The illustrated magnetic component 102 has an oval shape, but alternatively may have a different shape, such as a circular shape.

The substrate 104 has a thickness dimension 108 that is measured between a lower side 110 and an opposite upper side 112 of the substrate 104. As used herein, the terms "lower" and "upper" or "top" and "bottom" are used to refer to the opposite sides of the substrate 104. The use of the terms "lower" and "upper" or "top" and "bottom" are not meant to limit or require a single, specific orientation of the substrate 104. For example, the substrate 104 may be flipped over such that the upper side 112 is below the lower side 110.

For each magnetic component 102, several top conductors 120 are disposed on the upper side 112 of the substrate 104, and several bottom conductors 122 (shown in FIG. 3) are disposed on the lower side 110 of the substrate 104. The bottom conductors 122 may be the same size and/or shape as the top conductors 120. The substrate 104 includes conductive vias 124 that extend through the substrate 104 from the upper side 112 of the substrate 104 to the lower side 110 of the substrate 104. The vias 124 are filled or plated with a conductive material to provide conductive pathways through the substrate 104. Opposite ends of each via 124 are conductively coupled with the top conductors 120 and the bottom conductors 122 on the substrate 104. The vias 124, top conductors 120, and bottom conductors 122 form looping or winding conductive pathways that wrap around a ferrite material body 106 (shown in FIG. 2) that is disposed within the substrate 104.

Figure 2:
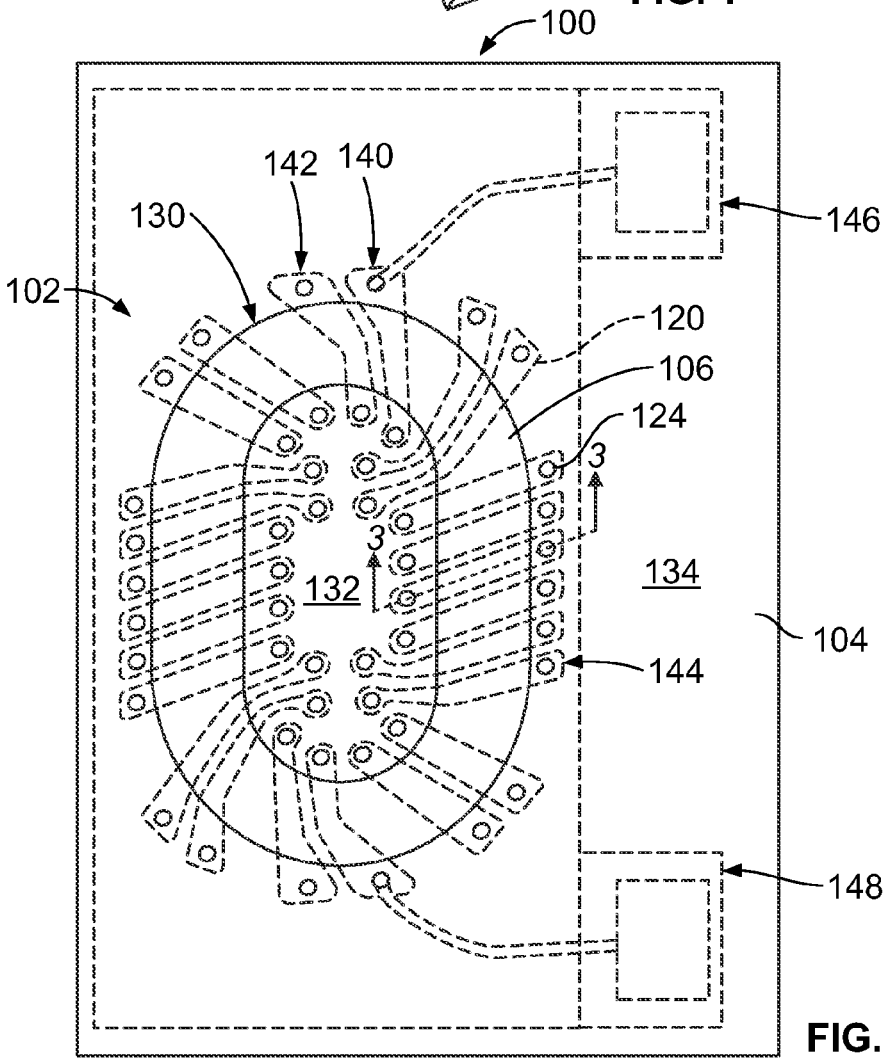
FIG. 2 is a top view of the planar electronic device.

FIG. 2 is a top view of the planar electronic device 100 showing the top conductors 120 in phantom view so that the location of the ferrite material body 106 in the magnetic component 102 may be more easily seen. The substrate 104 includes a cavity 130 that receives the ferrite material body 106. The substrate 104 includes an island 132 inside the cavity 130 that defines an inside wall of the cavity 130. The substrate 104 includes a shell 134 outside of the cavity 130 that defines an outside wall of the cavity 130. In the illustrated embodiment, the cavity 130 is oval-shaped, however other shapes are possible in alternative embodiments. The ferrite material body 106 is oval-shaped in correspondence with the oval-shaped cavity 130. The island 132 is received in the hole in the center of the ferrite material body 106.

The top conductors 120 are conductively coupled with the vias 124 at opposite ends of the top conductors 120. The vias 124 are located on both sides of the ferrite material body 106 (e.g. inside and outside). As described above, the vias 124 include conductive material and are conductively coupled with the bottom conductors 122 (shown in FIG. 3) disposed on the lower side 110 (shown in FIG. 1) of the substrate 104. The top conductors 120, the vias 124, and the bottom conductors 122 are arranged as coils that loop or wrap multiple times around the ferrite material body 106.

In the illustrated embodiment, the top conductors 120, the vias 124, and the bottom conductors 122 form two separate coils that may be referred to as primary and secondary conductive loops 140, 142. Each of the reference numbers 140, 142 in FIG. 2 point to dashed boxes that encircle a different conductive loop of the same magnetic component 102. Each conductive loop 140, 142 includes several turns 144 around the ferrite material body 106. The combination of the conductive loops 140, 142 and the ferrite material body 106 form the magnetic component 102. The conductive loops 140, 142 that wrap around the ferrite material body 106 are not conductively coupled with each other. Energy is coupled from the conductive loops 140, 142 through the ferrite material body 106 by magnetic induction at lower frequencies and by interwinding capacitance at higher frequencies. The spacing between the conductive loops 140, 142 is restricted due to limitations of etching processes or other deposition processes. The spacing between the conductive loops 140, 142 is restricted due to the specification of high dielectric isolation between the primary and secondary loops. In one embodiment, the first conductive loop 140 of the magnetic component 102 receives electric power from a first circuit 146, and the second conductive loop 142 of the magnetic component 102 is conductively coupled with a second circuit 148.

The first and second conductive loops 140, 142 can be inductively coupled with each other by the ferrite material body 106 such that electric current passing through the first conductive loop 140 is inductively transferred to the second conductive loop 142. For example, a varying electric current passing through the first conductive loop 140 can create a varying magnetic flux in the ferrite material body 106. The varying magnetic flux generates a varying magnetic field in the second conductive loop 142. The varying magnetic field induces a varying electromotive force, or voltage, in the second conductive loop 142. The second conductive loop 142 transfers the induced voltage to the second circuit 148.

Figure 3:
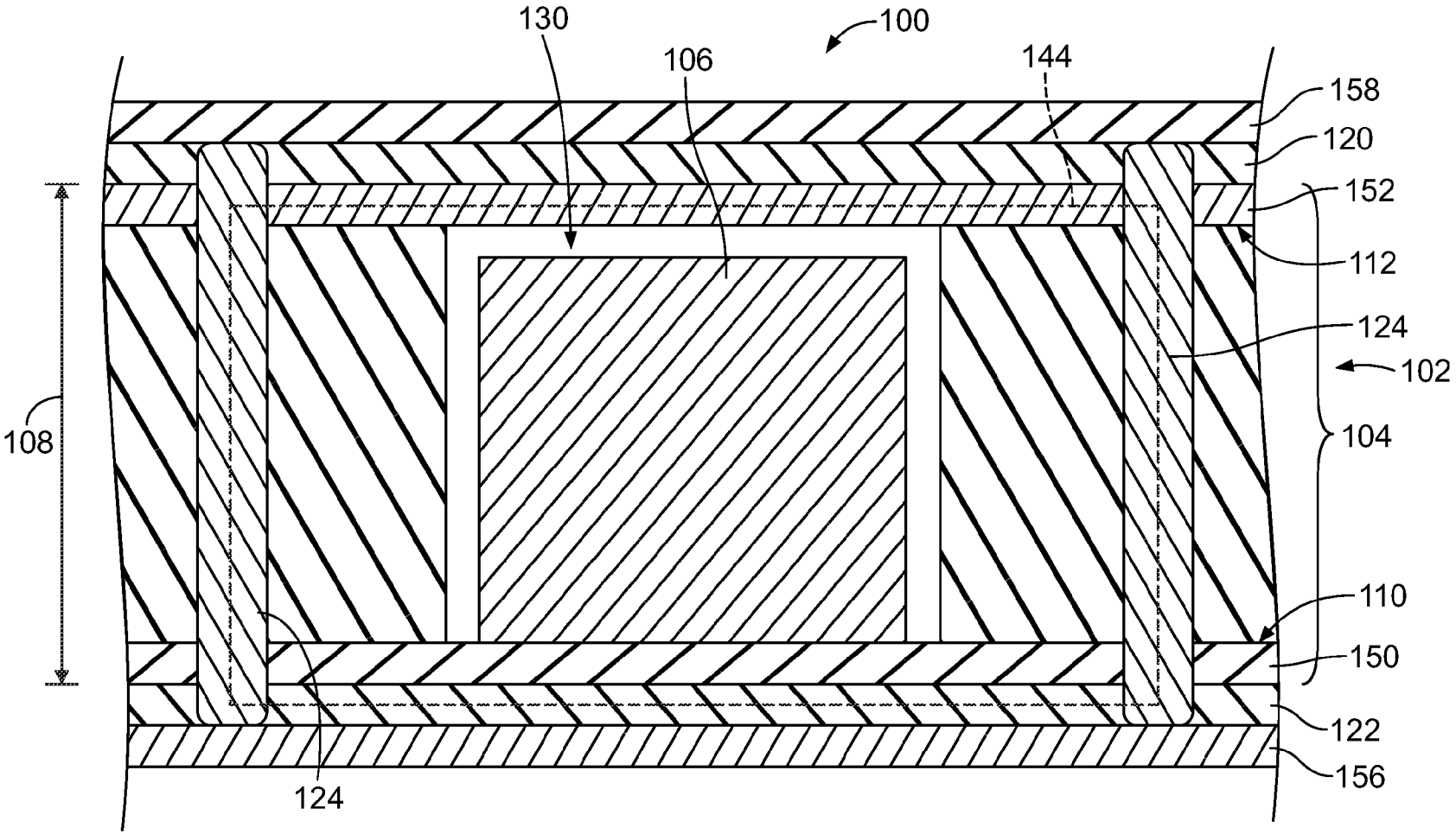
FIG. 3 is a cross-sectional view of the planar electronic device along line A-A shown in FIG. 2.

FIG. 3 is a cross-sectional view of the planar electronic device 100 along line A-A shown in FIG. 2. The planar electronic device 100 is a laminate structure having several layers disposed on top of each other. The substrate 104 can include or be formed from a dielectric material, such as a glass-filed epoxy (e.g., FR-4) suitable for a printed circuit board (PCB), a thermoset material, or a thermoplastic material. Alternatively, another rigid or semi-rigid material may be used for the substrate 104. The cavity 130 extends at least partially through the substrate 104 and provides an opening in which the ferrite material body 106 is disposed.

The substrate 104 includes lower and upper cover layers 150, 152 at the lower and upper sides 110, 112. The cover layers 150, 152 cover the lower and upper sides 110, 112 and the cavity 130. Optionally, other layers may be provided between the cover layers 150, 152 and the cavity 130. The lower and upper cover layers 150, 152 may be attached to the middle body of the substrate 104 using adhesive layers. The adhesive layers may be formed by depositing an epoxy, a low stress epoxy, a thermoplastic, a high temperature thermoplastic, or a high lateral flow ceramic filled hydrocarbon material. Alternatively, a different material may be used. The adhesive layers may be cured to provide mechanical stability to the substrate 104. Optionally, the lower and upper cover layers 150, 152 may comprise different materials and/or have different properties.

In an exemplary embodiment, the cover layers 150, 152 are manufactured from a high permittivity material and the high permittivity material increases primary to secondary capacitance. In an exemplary embodiment, the cover layers 150, 152 may have a permittivity greater than a permittivity of the middle layer(s) of the substrate 104. Optionally, the cover layers 150, 152 may have a permittivity at least two times the permittivity of the middle layer(s) of the substrate 104. The cover layers 150, 152 may have a relative permittivity greater than 5. The cover layers 150, 152 may have a relative permittivity greater than 10. The cover layers 150, 152 may have a relative permittivity greater than 15. The cover layers 150, 152 may have a relative permittivity greater than 20. Optionally, the cover layers 150, 152 may have a relative permittivity of between approximately 7 and 30. Optionally, the cover layers 150, 152 may have a relative permittivity of between approximately 18 and 22.

In an exemplary embodiment, the cover layers 150, 152 are manufactured from a high permittivity ceramic loaded prepreg material. The cover layers 150, 152 may be laminates having embedded high dielectric constant powders or materials. The cover layers 150, 152 may be resin coated capacitor foils. The cover layers 150, 152 may be microwave laminates. The cover layers 150, 152 may be ceramic-PTFE composite materials.

In an exemplary embodiment, the cover layers 150, 152 may be thin layers, particularly as compared to the middle layer(s) of the substrate 104. The cover layers 150, 152 may have a thickness of less than 200 microns. The cover layers 150, 152 may have a thickness of less than 100 microns. The cover layers 150, 152 may have a thickness of less than 50 microns. The cover layers 150, 152 may have a thickness of less than 20 microns. The cover layers 150, 152 may have a thickness of between approximately 10 and 100 microns.

In an exemplary embodiment, the top conductors 120 are secured to the upper cover layer 152 and the bottom conductors 122 are secured to the lower cover layer 150. The top and bottom conductors 120, 122 may be secured to the cover layers 152, 150 by depositing conductive layers (e.g., metal or metal alloy layers) onto the cover layers 152, 150. In one embodiment, the conductors 120, 122 are formed by selectively depositing copper or a copper alloy onto the cover layers 152, 150. One or more additional conductive or metal layers can be added by laminating additional upper and/or lower cover layers 150, 152 on or outside of the top and/or bottom conductors 120, 122 and then depositing additional conductive layers (such as additional top and/or bottom conductors 120, 122) on the additional cover layers. In alternative embodiments, the top and bottom conductors 120, 122 may be deposited on other layers and the cover layers 150, 152 may cover the conductors 122, 120, respectively.

As shown in FIG. 3, the vias 124 vertically extend through the substrate 104. For example, the vias 124 extend from the top conductor 120 to the bottom conductor 122 and pass throughout the entire thickness dimension 108 of the substrate 104. The vias 124 are filled with a conductive material, such as a metal or metal alloy, in the illustrated embodiment. Alternatively, the interior surfaces of the vias 124 may be plated with a conductive material. As described above, the vias 124 provide a conductive pathway that conductively couples the top and bottom conductors 120, 122. As shown in the cross-sectional view of FIG. 3, the top conductor 120, the bottom conductor 122, and the vias 124 form a single turn 144 that encircles or extends around the ferrite material body 106.

Lower and upper mask layers 156, 158 can be provided outside of the bottom and top conductors 122, 120. In one embodiment, the mask layers 156, 158 are solder mask layers that prevent exposure of portions of the bottom and top conductors 122, 120 to deposition of solder. For example, the mask layers 156, 158 may be provided on portions of the bottom and top conductors 122, 120 to prevent solder from being deposited on those portions. In an exemplary embodiment, the mask layers 156, 158 are manufactured from a high permittivity material and the high permittivity material increases primary to secondary capacitance. Alternatively, the mask layers 156, 158 may not be included in the magnetic component 102. The mask layers 156, 158 may define cover layers and may be referred to herein as cover layers 156, 158.

In an alternative embodiment, rather than having the lower cover layer 150, the planar electronic device 100 may have the bottom conductors 122 directly deposited on the lower side 110 of the substrate 104. In such embodiment, because a high permittivity cover layer 150 is not used on the bottom, the upper cover layer 152 may be manufactured from a high permittivity material having a higher permittivity than the embodiment where the lower cover layer 150. Using the even higher permittivity material compensates for the lack of capacitance compensation that would otherwise be provided by the lower cover layer 150.

Figure 4:
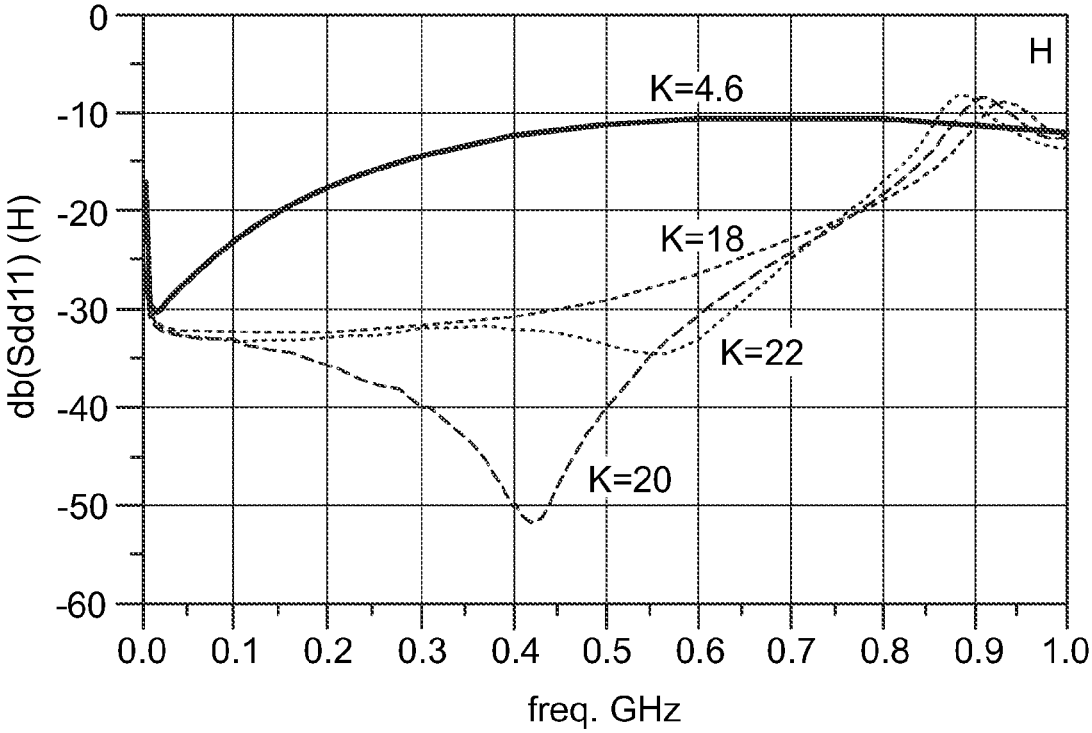
FIG. 4 is a graph showing return loss of the planar electronic device using cover layers having various dielectric constants.

FIG. 4 is a graph showing return loss of the planar electronic device 100 using cover layers 150, 152 having various dielectric constants. The graph shows return loss at different frequencies. The graph shows return loss of the planar electronic device 100 using cover layers 150, 152 having a dielectric constant of 4.6, a dielectric constant of 18, a dielectric constant of 20, and a dielectric constant of 22. It is clear that performance of the planar electronic device 100 improves when high permittivity material is used, as compared to using a lower permittivity material, such as glass epoxy. In an exemplary embodiment, the material of the cover layers may be FaradFlex®, commercially available from Oak Mitsui Technologies, which can have a dielectric constant of between approximately 18 and 30.

Figure 5:
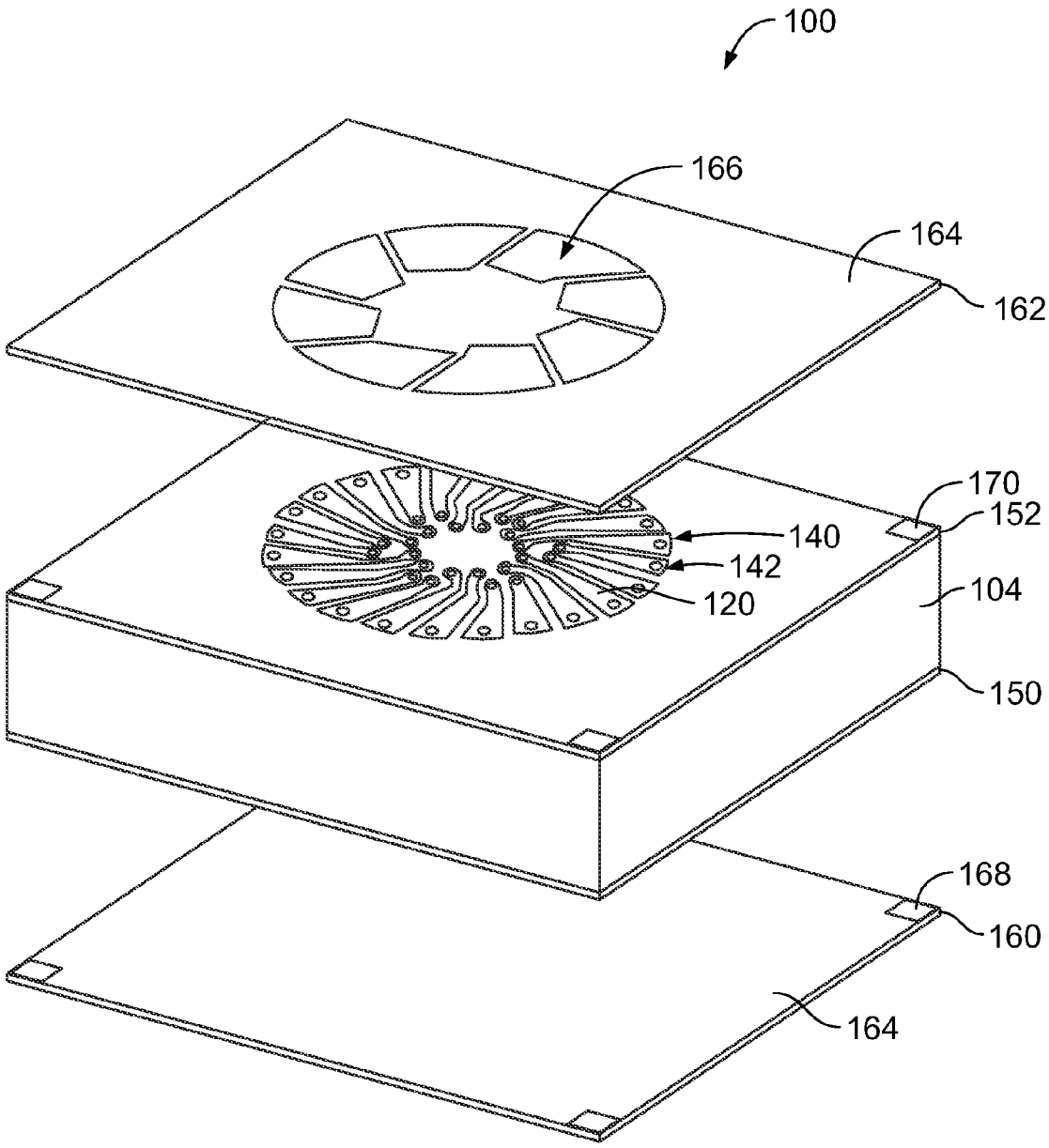
FIG. 5 is an exploded view of the planar electronic device showing lower and upper metalized cover layers.

FIG. 5 is an exploded view of the planar electronic device 100 using lower and upper metalized cover layers 160, 162. The metalized cover layers 160, 162 may be similar to one another. The metalized cover layers 160, 162 each include a sheet 164 and one or more metal petals 166. The sheet 164 may be a laminated structure. The sheet 164 may be a flexible sheet or may be a rigid sheet, such as a board. The sheet 164 may be manufactured from glass epoxy, such as FR-4 material. Optionally, the sheet 164 may be manufactured from a high permittivity material. Optionally, the metalized cover layers 160, 162 may be four layer circuit boards. The petals 166 increase the capacitance between the primary and secondary conductive loops 140, 142 (shown in FIG. 2). Optionally, the use of the metalized cover layers 160, 162 may provide sufficient capacitance increase to alleviate the need for the high permittivity material in the cover layers 150, 152, allowing the cover layers 150, 152 to be made from less expensive material.

In the illustrated embodiment, multiple petals 166 are deposited on the sheets 164 by depositing conductive layers (e.g., metal or metal alloy layers) onto the cover layers 160, 162. In one embodiment, the petals 166 are formed by selectively depositing copper or a copper alloy onto the cover layers 160, 162. The petals 166 may be separated from each other by gaps. The size and shape of the petals 166 correspond to the layout of the conductors 120, 122. The pattern of the petals 166 may be designed with consideration to capacitive coupling with the conductors 120, 122. For example, design consideration may be given to the thicknesses of the sheets 164, the relative permittivities of the materials of the sheets 164, the cover layers 150, 152, the pre-preg layers, the mask layers, any air gaps and/or underfill materials, and the like.

When the metalized cover layers 160, 162 are provided on the substrate 104, the petals 166 are aligned with corresponding conductors 120, 122 to increase the capacitance between the primary and the secondary conductive loops. The petals 166 are capacitively coupled to broadsides of the conductors 120, 122 by covering such conductors 120, 122 and by the close positioning of the petals 166 to the conductors 120, 122. The electric fields of the primary and secondary conductive loops are altered by the petals 166, which can improve the return loss of the planar electronic device 100. Each petal 166 can overlap a single group of the conductors 120, 122, such as a grouping of one primary and one secondary conductive loop, a grouping of one primary and multiple secondary conductive loops, a grouping of multiple primary and multiple secondary conductive loops, or a grouping of multiple primary conductive loops and a single secondary conductive loop. In alternative embodiments, rather than having individual petals, a single continuous metal petal 166, such as a ring shaped metal petal, may be provided that covers all of the conductors 120, 122.

The metalized cover layers 160, 162 are attached to the substrate 104, such as to the cover layers 150, 152, by coupling solder pads 168 on the metalized cover layers 160, 162 to corresponding solder pads 170 on the substrate 104. Alternatively, the metalized cover layers 160, 162 may be attached to the substrate 104 by other means, such as by laminating the metalized cover layers 160, 162 to the substrate 104.

Figure 6:
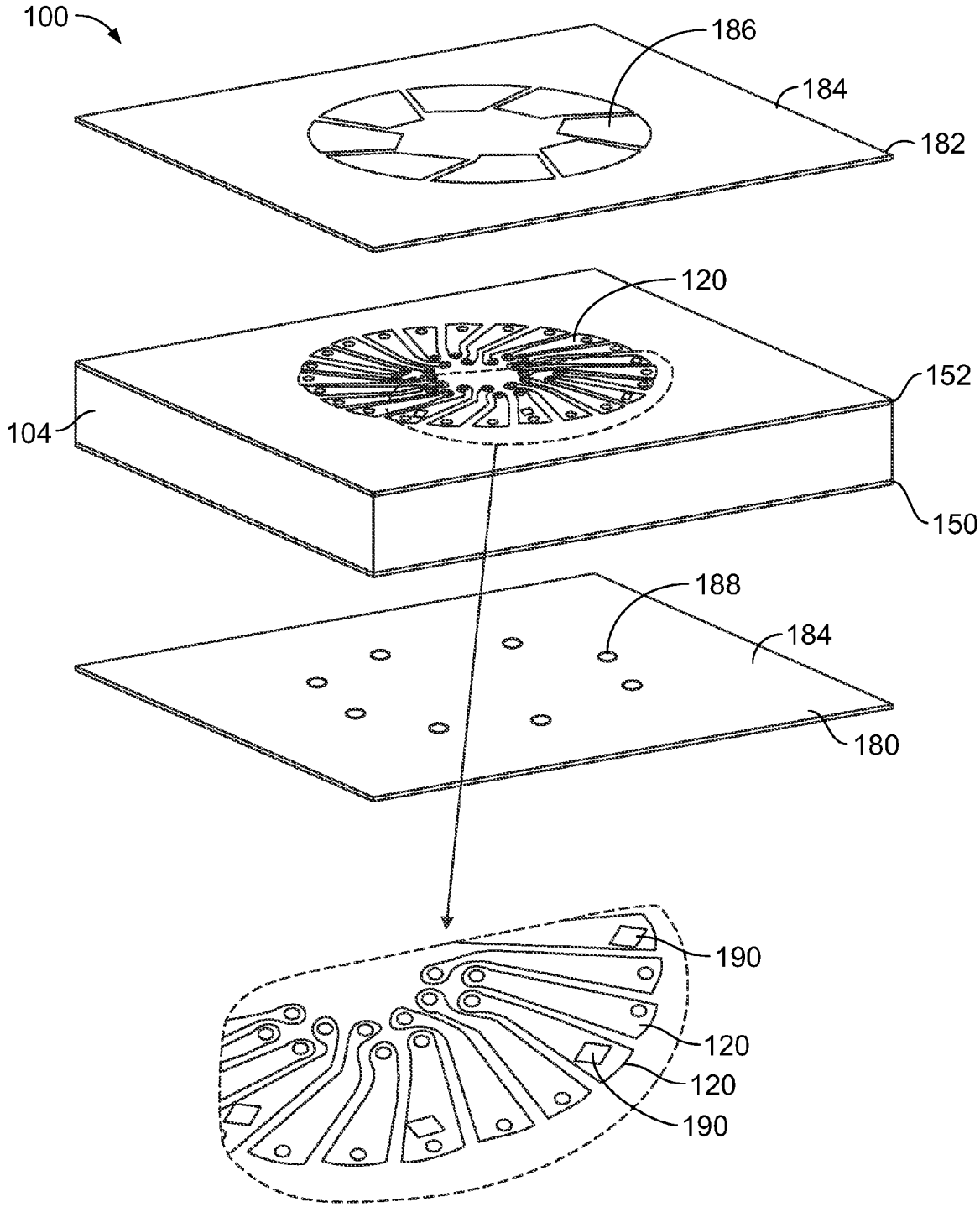
FIG. 6 is an exploded view of the planar electronic device showing lower and upper metalized cover layers.

FIG. 6 is an exploded view of the planar electronic device 100 using lower and upper metalized cover layers 180, 182. The metalized cover layers 180, 182 may be similar to the metalized cover layers 160, 162 (shown in FIG. 5), however metal petals 186 are directly electrically connected to corresponding conductors 120, 122 and are capacitively coupled to other conductors 120, 122. The metalized cover layers 180, 182 each include a sheet 184 and one or more metal petals 186. Optionally, the metalized cover layers 180, 182 may be four layer circuit boards. The petals 186 increase the capacitance between the primary and secondary conductive loops 140, 142 (shown in FIG. 2).

When the metalized cover layers 180, 182 are provided on the substrate 104, the petals 186 are aligned with corresponding conductors 120, 122 to increase the capacitance between the primary and the secondary conductive loops. The electric fields of the primary and secondary conductive loops are altered by the petals 186, which can improve the return loss of the planar electronic device 100. Each petal 186 can overlap a single group of the conductors 120, 122, such as a grouping of one primary and one secondary conductive loop, a grouping of one primary and multiple secondary conductive loops, a grouping of multiple primary and multiple secondary conductive loops or a grouping of multiple primary conductive loops and a single secondary conductive loop. In alternative embodiments, rather than having individual petals, a single continuous metal petal 186, such as a ring shaped metal petal, may be provided that covers all of the conductors 120, 122.

The metalized cover layers 180, 182 are attached to the substrate 104, such as to the cover layers 150, 152, by coupling solder pads 188 on the metalized cover layers 180, 182 to corresponding solder pads 190 on the substrate 104. In an exemplary embodiment, the solder pads 188 are electrically coupled to the petals 186, such as by conductive vias through the sheet 184. The solder pads 190 are located directly on corresponding conductors 120, 122. Optionally, each conductor 120, 122 of the primary conductive loop 140, defining primary windings, has a corresponding solder pad 190 thereon. As such, each of the primary windings is directly electrically connected to the petals 186 when the metalized cover layers 180, 182 are coupled thereto. The conductors 120, 122 of the secondary conductive loop 142, defining secondary windings, are capacitively coupled to the petals 186 rather than being directly electrically coupled. In alternative embodiments, the solder pads 190 may be provided on the secondary windings and the petals may be directly electrically coupled to the secondary windings rather than the primary windings.

Figure 7:
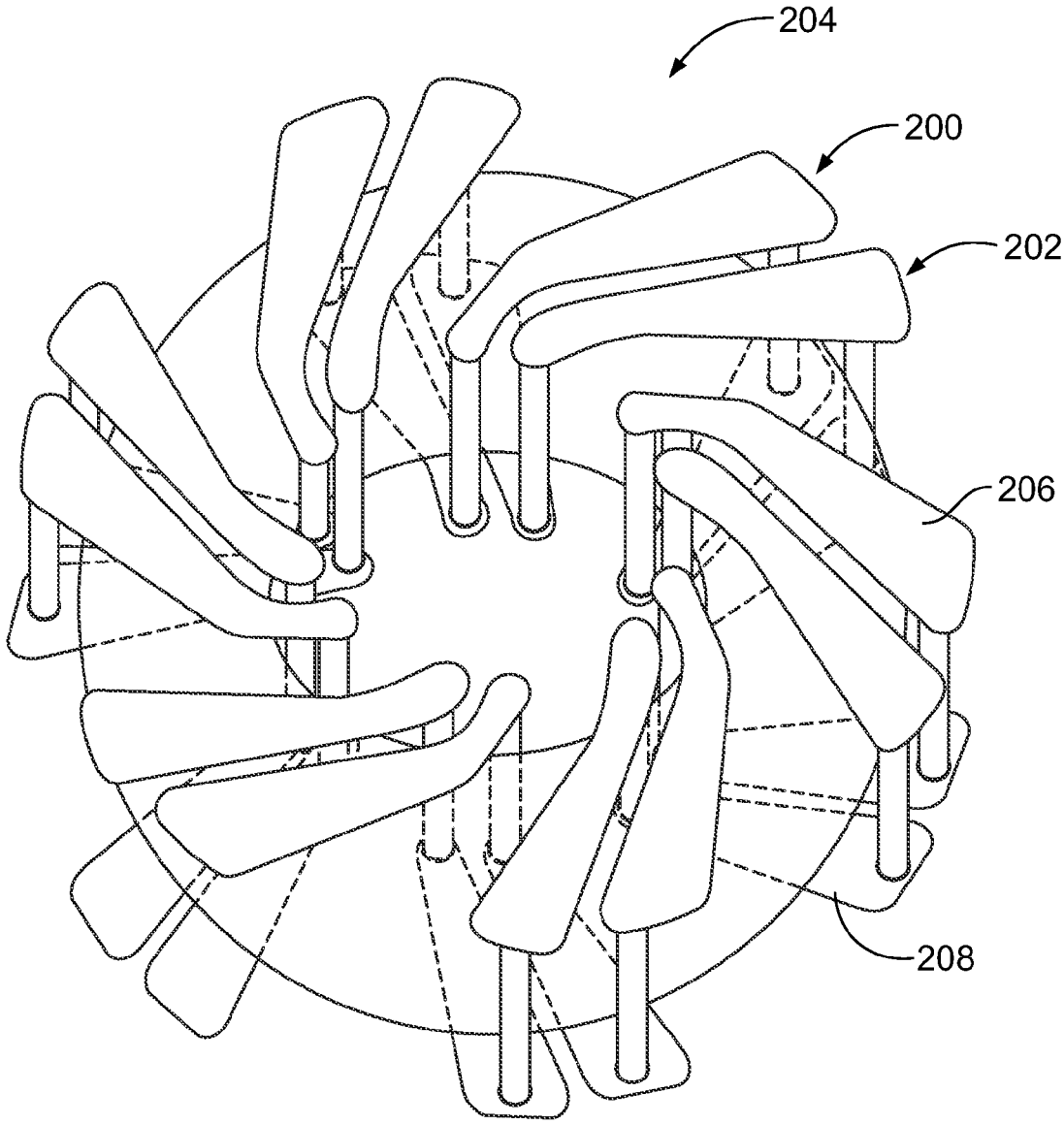
FIG. 7 illustrates a portion of a planar electronic device formed in accordance with an exemplary embodiment.

FIG. 7 illustrates primary and secondary conductive loops 200, 202 of another planar electronic device 204. A substrate and one or more cover layers may be provided to provide capacitance compensation for the primary and secondary conductive loops 200, 202. In the illustrated embodiment, top conductors 206 and bottom conductors 208 are grouped together in pairs. In the illustrated embodiment, one top conductor 206 of each group is part of the primary conductive loop 200 and one top conductor 206 of each group being part of the secondary conductive loop 200. Similarly, one bottom conductor 208 of each group is part of the primary conductive loop 200 and one bottom conductor 208 of each group being part of the secondary conductive loop 200. The top and bottom conductors 206, 208 within each group are spaced closer together than a spacing between the adjacent group.

In an exemplary embodiment, top and/or bottom cover layers (not shown) are used to increase capacitive coupling between the conductors 206, 208 of the primary and secondary conductive loops 200, 202. The top and/or bottom cover layers may be manufactured from a material having a high relative permittivity. The top and/or bottom cover layers may be metalized, such as including one or more metal petals, to increase capacitive coupling between the conductors 206, 208 of the primary and secondary conductive loops 200, 202.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A planar electronic device comprising:

a planar substrate having a cavity configured to receive a ferrite material body therein, the planar substrate having an upper side and a lower side;

conductive vias extending through the substrate;

top conductors on the upper side of the planar substrate and electrically connected to corresponding conductive vias;

bottom conductors on the lower side of the planar substrate and electrically connected to corresponding conductive vias, wherein the bottom conductors, the top conductors and the conductive vias define a primary conductive loop and a secondary conductive loop; and an upper cover layer covering the upper side, the upper cover layer comprising a material having a high permittivity with a dielectric constant at least two times a dielectric constant of the planar substrate, the upper cover layer being positioned relative to the top conductors to increase capacitance between the primary and secondary loops.

2. The planar electronic device of claim 1, wherein the upper cover layer comprises a sheet of high permittivity ceramic loaded pre-preg material.

3. The planar electronic device of claim 1, wherein the upper cover layer is a solder mask.

4. The planar electronic device of claim 1, wherein the top conductors are deposited on the upper cover layer.

5. The planar electronic device of claim 1, wherein the upper cover layer is laminated over the top conductors.

6. The planar electronic device of claim 1, wherein the upper cover layer includes a plurality of metal petals, each metal petal covering at least one top conductor of the primary conductive loop and at least one top conductor of the secondary conductive loop to increase capacitance between the corresponding primary and secondary conductive loops.

7. The planar electronic device of claim 1, wherein the upper cover layer has a dielectric constant of at least 15.

8. The planar electronic device of claim 1, wherein the upper cover layer is a flex sheet having a thickness of between approximately 100 microns and 200 microns.

9. The planar electronic device of claim 1, wherein adjacent top conductors define top conductor groups, the top conductor groups including at least one top conductor of the primary conductive loop and at least one top conductor of the secondary conductive loop, the upper cover layer including metal petals covering corresponding top conductor groups in a one-to-one ratio.

10. The planar electronic device of claim 9, wherein the metal petals are capacitively coupled to broadsides of the corresponding top conductors.

11. The planar electronic device of claim 9, wherein the metal petals are directly electrically coupled to the top conductors of the primary conductive loop and the metal petals are capacitively coupled to the top conductors of the secondary conductive loop.

12. The planar electronic device of claim 1, further comprising a lower cover layer covering the lower side, the lower cover layer having a high permittivity and positioned relative to the bottom conductors to increase capacitance between the primary and secondary loops.

* * * * *